United States Patent [19]

Lieberman

[11] 4,294,143

[45] Oct. 13, 1981

[54] METHOD AND APPARATUS FOR CUTTING INTO SEGMENTS A CONTINUOUSLY MOVING WEB OF RIGID INSULATION

[76] Inventor: Abraham Lieberman, 4555 Bonavista Ave., Apt. 31, Montreal, Quebec, Canada, H3W 2C7

[21] Appl. No.: 87,499

[22] Filed: Oct. 23, 1979

[51] Int. Cl.[3] ..... B26D 1/18; B26D 1/24; B26D 1/56

[52] U.S. Cl. ..... 83/37; 83/51; 83/326; 83/329; 83/446; 83/500; 83/483

[58] Field of Search ..... 83/483, 485, 486, 486.1, 83/487, 488, 418–420, 498–503, 51, 329, 448, 449, 341, 326, 37, 446

[56] References Cited

U.S. PATENT DOCUMENTS

| | | | |
|---|---|---|---|
| 1,623,354 | 4/1927 | Messer | 83/326 X |
| 2,378,428 | 6/1945 | Odian | 83/487 |
| 2,777,521 | 1/1957 | Tanis | 83/488 X |
| 3,138,049 | 6/1964 | Flory et al. | 83/486 X |
| 3,340,909 | 9/1967 | Vidal | 83/488 |
| 3,463,040 | 8/1969 | Pouilloux | 83/487 X |
| 3,528,329 | 9/1970 | Chartet | 83/37 |
| 3,704,642 | 12/1972 | Dryon | 83/326 X |
| 3,757,618 | 9/1973 | Kuts | 83/483 X |
| 3,768,350 | 10/1973 | Coulter | 83/488 X |
| 3,802,306 | 4/1974 | Brown et al. | 83/326 X |
| 3,807,261 | 4/1974 | Couvreur | 83/326 X |
| 3,851,445 | 12/1974 | Schuh | 83/326 X |
| 3,905,261 | 9/1975 | Okuyama | 83/326 X |
| 3,974,725 | 8/1976 | Boots | 83/420 X |
| 4,007,652 | 2/1977 | Shinomiya et al. | 83/326 X |

*Primary Examiner*—Frank T. Yost

*Attorney, Agent, or Firm*—Finnegan, Henderson, Farabow, Garrett & Dunner

[57] ABSTRACT

Two chain-type endless belts are positioned to transversely span a continuously moving strip-like web, one belt facing each of the two major web surfaces, the belts oriented at an acute angle to the longitudinal web axis. Disk-type freely rotatable cutters are mounted on the endless belts for movement across the web with the blade cutting axes aligned perpendicular to the longitudinal web axis, and the endless belts are synchronized to provide cooperation between an individual blade on one belt and a corresponding blade on the other belt to engage and shear the web in a "scissoring" action. Another endless belt engages the last cut longitudinal web edge to provide biasing against unbalanced forces parallel to the major web surfaces produced by the blades.

28 Claims, 7 Drawing Figures

METHOD AND APPARATUS FOR CUTTING INTO SEGMENTS A CONTINUOUSLY MOVING WEB OF RIGID INSULATION

BACKGROUND OF THE INVENTION

1. Field of the Invention

The apparatus and method of the present invention is for transversely cutting into segments a continuous strip-like web of material moving along the strip axis.

2. Description of the Prior Art

Probably the most commonly used types of apparatus for transversely cutting a moving strip-like web are the guillotine-type cutters. These apparatus are characterized by a blade which completely spans the web in the transverse direction and which reciprocates in a plane perpendicular to the longitudinal axis of the web. The period of reciprocation together with the speed of the web along the longitudinal axis determine the lengths of the cut material. While this general type of cutting apparatus has been used satisfactorily in the insulation-board fabrication industry, the apparatus is satisfactory only for certain limited applications, namely those involving low web speeds and homogenous insulation materials.

Modern insulation-board materials and forming techniques have rendered the guillotine-type cutting apparatus unsatisfactory for several reasons. Modern techniques and equipment have enabled the rate at which the continuous web of material is formed to be increased dramatically, and production and conveying speeds of 200 feet per minute are now possible with some insulation materials. At these high production speeds, the short but finite length of time that the blades of the guillotine-type cutters engage the web result in a "pile up" of the material behind the blade. This pile up can cause unacceptable deformation of the board edge, resulting in scrap material, and can also result in jamming of the forming and conveying machines at high production speed. Hence, production speeds for guillotine-type cutting apparatus are understandably limited to well under 200 feet per minute in the insulation-board industry.

Another and equally significant limitation on the guillotine-type cutting apparatus is that it is difficult to completely cut composite or laminated insulation material without deforming the structure of the material immediately adjacent to the cut. The variations in the longitudinal tensile strengths of the separate materials in the composite or lamination, together with the generally low compressive strength of some foamed insulation materials, are responsible for this limitation. For some of the newer composite insulation materials such as fiberglass-reinforced foamed polyurethane insulation board, this limitation renders the guillotine-type cutter almost totally unacceptable.

Some attempts have been made in the insulation-board industry to circumvent the problem of cutting moving webs of composite materials, but these have achieved only marginal success. One such attempt involves apparatus which accomplishes the cutting with a travelling saw element. Certain problems and limitations remain even with the use of such apparatus for cutting composite insulation materials. It is understood in the insulation-board industry that saw elements can have unacceptably high waste rates. For certain types of insulation, a large percentage of the saw-cuttings is in the form of dust. This dust can be hard to control and under certain conditions can constitute a fire hazard or a health hazard. For instance, dust from saw-cut insulation board containing asbestos, a common insulation material, would be expected to be particularly dangerous. And finally, certain materials, such as bituminous felt, which are often used in composite insulation materials adhere to and clog saw elements necessitating frequent shutdowns for cleaning and a consequent increase in downtime costs.

SUMMARY OF THE INVENTION

In view of the apparatus presently used to cut moving strip-like webs, especially webs of composite insulation materials, it is an objective of the present invention to provide apparatus for transversely cutting strip-like webs of material, particularly composite insulation materials, moving at a high rate of speed along the strip longitudinal axis, with the web being completely severed but with a minimum of deformation of the edges of the immediately adjacent uncut material, and with a minimum of cutter leavings and dust formation.

It is also an objective of the present invention to provide a method and apparatus for transversely cutting relatively thick strip-like webs of composite insulation materials while maintaining close tolerances in the cut lengths. Web thickness of about $\frac{1}{2}$ to about 3 inches and tolerances of $\pm 1/32$ inch in the length are contemplated applications of the present invention. Also, cut board lengths can range from about 3 feet to about 16 feet.

In accordance with the invention, as embodied and broadly described herein, the apparatus of this invention for transversely cutting into predetermined lengths a continuous strip-like web, the web being conveyed along its longitudinal axis, comprises means for simultaneously engaging and cutting into the moving web at both major web surfaces, the means including at least one pair of cooperating blades; means for simultaneously transporting the blade pair transversely across the web and longitudinally in the direction of conveyance of the web, wherein each blade of the pair cooperates with the other blade to provide mutually opposing forces biasing the web against the cutting action of each of the cooperating blades for completely shearing the web through its thickness; and means associated with the transporting means for aligning each blade of the blade pair such that the plane of the respective blade is perpendicular to the longitudinal axis of the web.

Broadly, the transporting means including first travelling carriage means positioned adjacent one major surface of the web and oriented to traverse the web along a first carriage path disposed at a first angle to the longitudinal axis of the web, the first travelling carriage means carrying a first blade; second travelling carriage means positioned adjacent the other major surface of the web and oriented to traverse the web along a second carriage path disposed at a second angle to the longitudinal axis, the second travelling carriage means carrying a second blade; means for synchronizing the speed of the first travelling carriage means with the speed of the second travelling carriage means, wherein the first blade cooperates with the second blade to provide the mutually opposing forces.

Preferably, each blade of the pair of blades is disk-shaped, freely rotatable about its center, and rotates in an angular direction opposite to that of the cooperating blade.

It is also preferred that wherein the mutually opposing forces also have force components parallel to the web surface, the apparatus further includes means for biasing the web against the parallel force components, the biasing means acting on the web along substantially the entire longitudinal web distance over which the cooperating blades engage the web material.

It is also preferred that the transporting means includes first and second stationary frame means positioned adjacent the opposite major web surfaces, and wherein the first and second travelling carriage means include, respectively first and second endless belt means supported in the respective frame means to span the web along respective ones of the first and second carriage paths, and wherein the aligning means includes a plurality of assemblies for holding the individual blades of the blade pair, and wherein each of the first and second endless belt means includes a pair of endless chains mounted side-by-side, in spaced relationships, and wherein each of the plurality of blade-holder assemblies is attached by securing means to each chain in the respective pair for suspension therebetween.

And it is still further preferred that the synchronizing means further includes means for continuously adjusting and controlling the speeds of the first and second endless belt means to compensate for variations in the conveyed web speed.

Still in accordance with the present invention, as embodied and broadly described herein, the method for transversely cutting into predetermined lengths a continuous strip-like web, the web being conveyed along its longitudinal axis, comprises engaging, at one major web surface, a first longitudinal edge of the web with a first blade aligned with its plane perpendicular to the longitudinal axis of the web; engaging, at the opposite major web surface and at the approximate axial position of engagement of the first blade, the first longitudinal edge of the web with a second blade aligned with its plane perpendicular to the longitudinal axis of the web; moving together in cooperating relationship the first and second blades transversely across and longitudinally in the direction of web conveyance at speeds determined in relation to the web speed and the angle of movement with respect to the longitudinal axis for providing a cut edge perpendicular to the longitudinal axis, the first and second blades providing mutually opposing forces biasing the web against each of the blades for scissoring the web therebetween; disengaging the first and second blades from the web at the other longitudinal edge of the web; and returning the first and second blades to the first longitudinal edge by separate return paths.

Broadly, the moving step includes the step of continuously adjusting and controlling the speeds of the first and second blades to compensate for variations in the web speed.

Preferably, the method further comprises biasing the web against unbalanced force components directed parallel to the major web surfaces, the unbalanced parallel force components being produced by the first and second blades and being directed from the first longitudinal web edge toward the other longitudinal web edge.

The accompanying drawing which is incorporated in and constitutes a part of this specification, illustrates one embodiment of the invention and, together with the description, serves to explain the principles of the invention.

DESCRIPTION OF THE PREFERRED EMBODIMENT

Reference will not be made in detail to the present preferred embodiment of the invention, an example of which is illustrated in the accompanying drawing.

Figure 1:
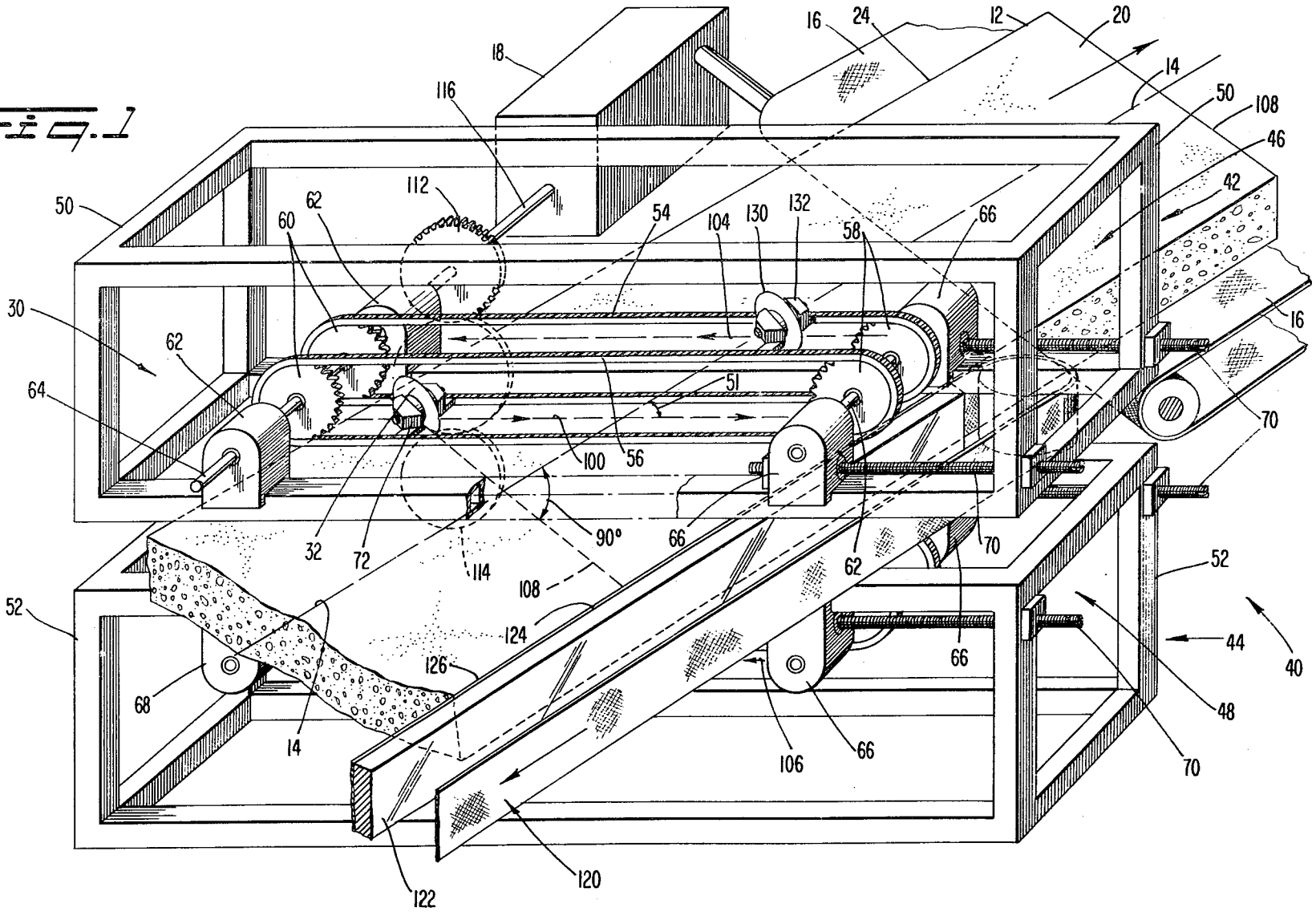
FIG. 1 is a perspective view of a schematic of apparatus constructed in accordance with the present invention, which apparatus surrounds a continuous strip-like web of material being conveyed.

The preferred embodiment of the present invention is designated generally as 10 in FIG. 1 and is shown surrounding a strip-like web 12 of insulation-board material. Web 12 is shown moving along its longitudinal axis 14 on conveyor 16 which may be driven such as by conventional conveyor driving means 18. For points of reference in the succeeding discussion, web 12 is deemed to have major planar surfaces 20 and 22, and longitudinal edges 24 and 26.

Although the scope of the present invention is not limited to specific kinds of web material, the present invention is particularly useful in cutting composite or laminated insulation-board material, such as foamed insulation board with outer skins of aluminum, asbestos, fiberglass, bituminous, or other materials. These materials generally are continuously formed by machine (not shown) and carried by another portion of conveyor 16 (not shown) to the cutting apparatus 10. The web material is shown being conveyed horizontally in the figures but the present invention can be easily adapted to other orientations such as vertical conveyance.

In accordance with the present invention, being apparatus for transversely cutting into predetermined lengths a continuously moving strip-like web such as web 12, there is provided means for simultaneously engaging and cutting into the moving web at both major web surfaces, the means including at least one pair of cooperating blades. As embodied herein, and as best seen in FIGS. 1 and 4, means 30 include blades 32 and 34 which are disposed to penetrate opposite major web surfaces 20 and 22, respectively.

Figure 3:
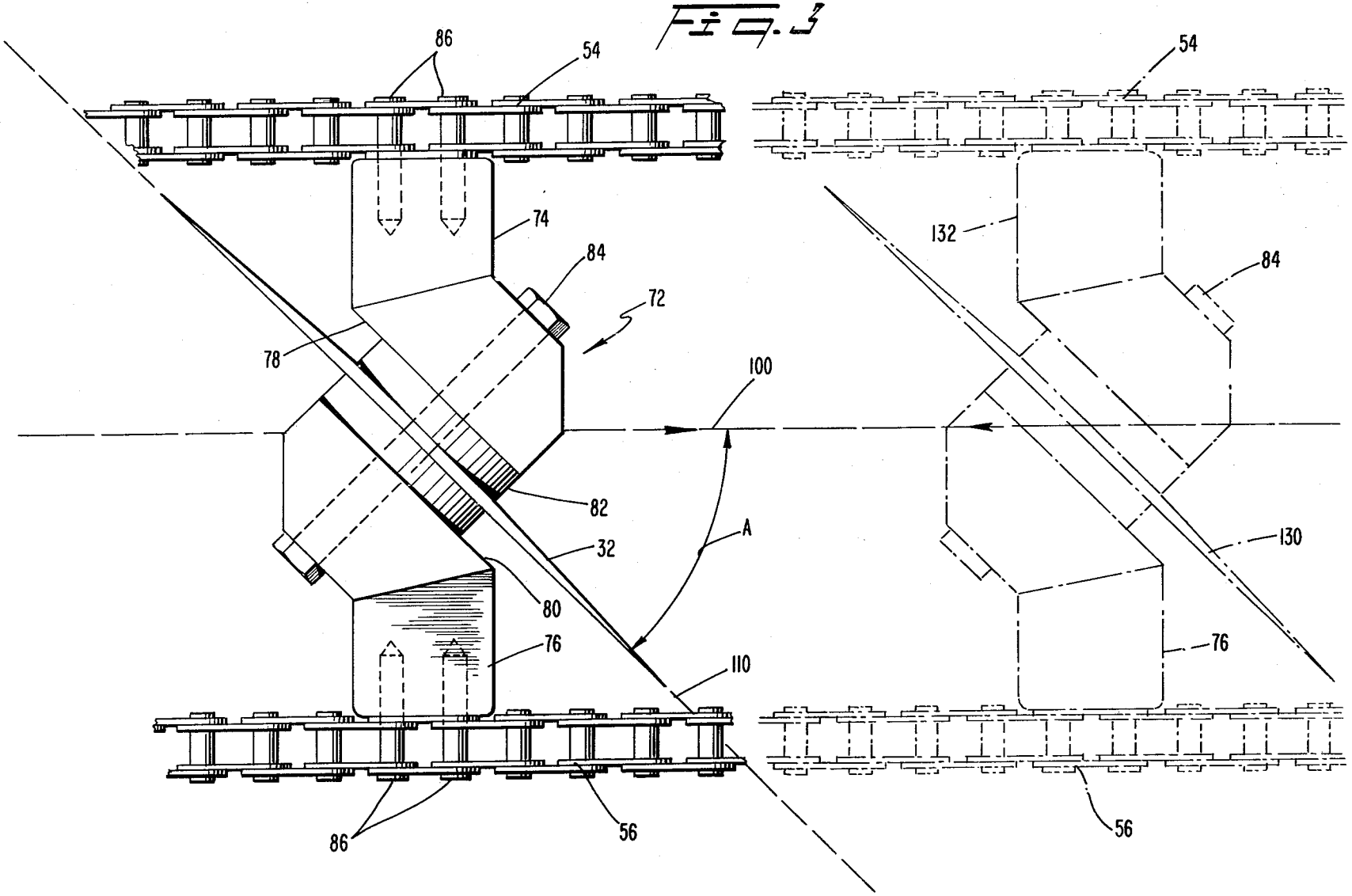
FIG. 3 is a detail of a component of the apparatus shown in FIG. 1.
Figure 4A:
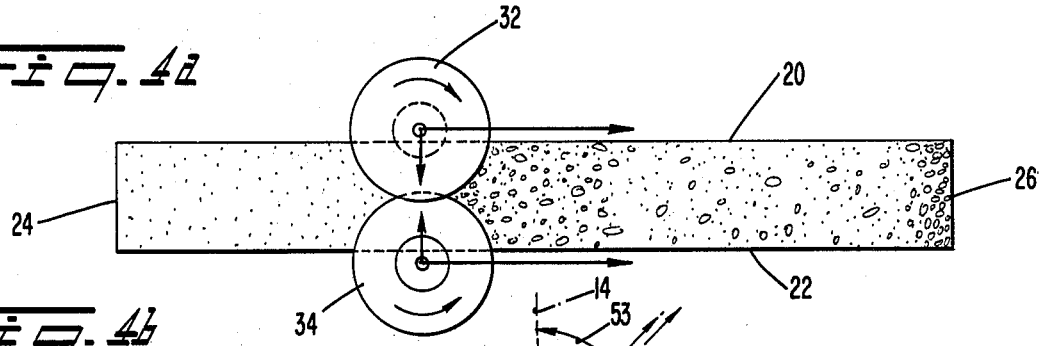
FIG. 4*a* is an edge-on detail view of the web cut with the apparatus depicted in FIG. 1.

It is presently preferred that each of the blades 32 and 34 is disk shaped and mounted for rotation in respective blade-holder assemblies, such as assembly 72 (to be discussed in greater detail henceforth-see FIG. 3). Although blades 32 and 34 can be caused to rotate by separate driving means (not shown) which could be included in means 30, it is also presently preferred that the blades 32 and 34 be freely rotatable under the action of the movement of the blades through the web material. As shown in FIG. 4*a,* the disk shape of blades 32 and 34 causes rotation in opposite directions whereupon the web material is engaged, forced toward the center of the web thickness, and eventually severed.

The total of the penetration depths of blades 32 and 34 into surfaces 20 and 22 respectively should be equal to or greater than the thickness of web 12 to ensure complete cutting. It is presently preferred that the penetration depths of blades 32 and 34 be equal and each slightly greater than one-half the web thickness.

Figure 4B:
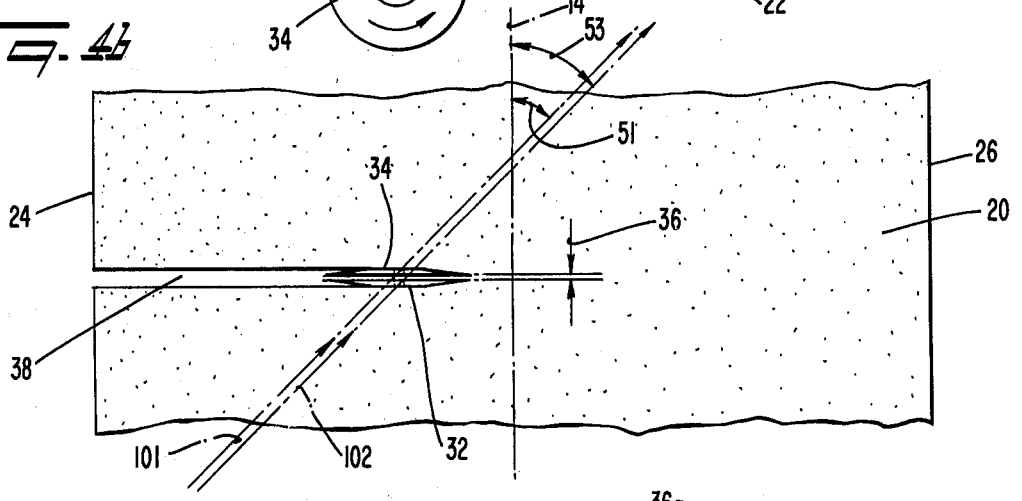
FIG. 4*b* is a top view the detail of FIG. 4*a;*

It can be appreciated from FIGS. 4*a* and 4*b* that blades 32 and 34 cooperate to cut the web material in a "scissoring" fashion as the blades are transported across web 12. The "scissoring" action is accomplished because web material is engaged or trapped between the opposing blades whereby the force of the cutting action of each blade urges the web against the other blade, creating mutually opposing biasing forces characteristic of a "scissoring" action.

It can also be appreciated from FIGS. 4*a* and 4*b* that, as a consequence of the overlapping penetration depths of blades 32 and 34, a "cutting clearance" between the blades 32 and 34 is required to prevent interference between the blades. In the embodiment shown in FIGS. 4*a* and 4*b*, cutting paths 100 and 102 (to be described in more detail henceforth) which correspond to the motion of blades 32 and 34 with respect to ground are spaced axially with respect to axis 14, while the blades 32 and 34 occupy essentially the same transverse position along their respective paths. This spacing provides a cutting clearance 36 between the respective blades, which clearance is exaggerated in the figure for purposes of clarity. The actual dimensions of clearance 36 understandably will be made as small as possible to augment the "scissor effect" while accommodating dimensional tolerances and "play" between parts of the apparatus. The dimensions of gap 38 produced by the passage of blades 32 and 34 across the web is also exaggerated for clarity, and the actual gap dimension will depend on many factors including the resilience of the web material, the magnitude and direction of the conveying forces, and the amount, if any, of material actually separated from the cut edge surface in the form of "chips" or "leavings".

Figure 5A:
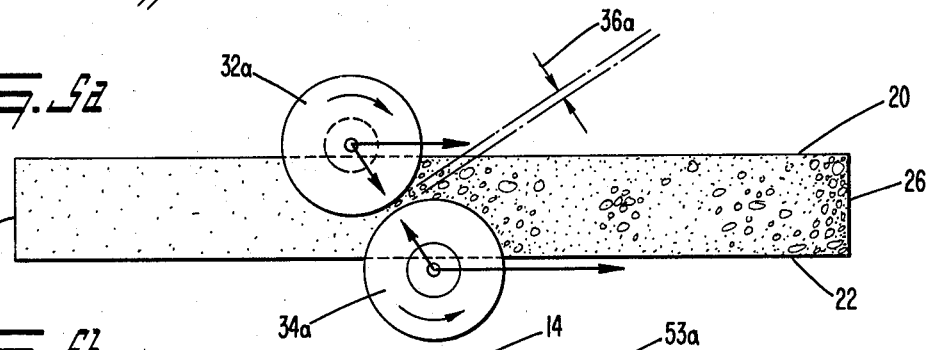
FIG. 5*a* is an edge-on detail view of the web cut with a modification of the apparatus depicted in FIG. 1.
Figure 5B:
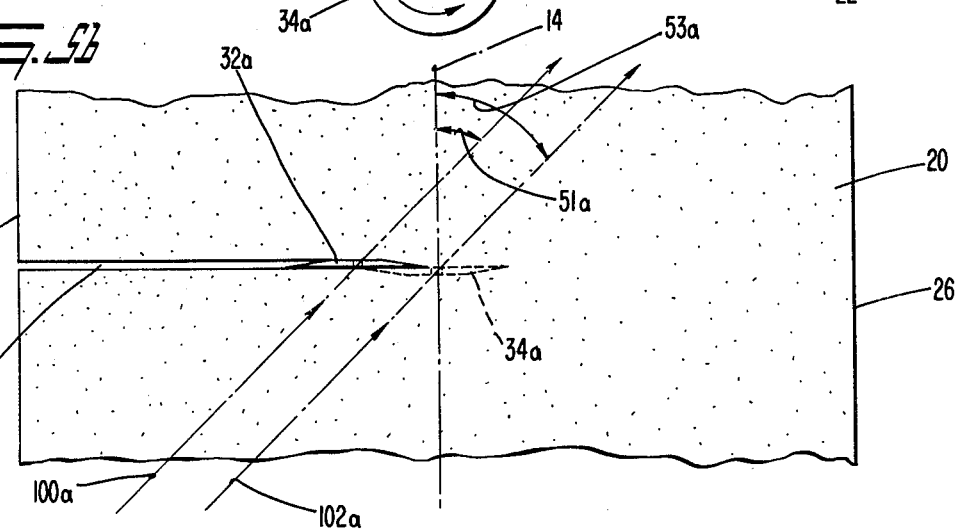
FIG. 5*b* is a top view of the detail of FIG. 5*a.*

FIGS. 5*a* and 5*b* present an alternative configuration for providing a cutting clearance. In the configuration shown in these Figures, cutting paths 100*a* and 102*a* of blades 32*a* and 34*a* are spaced axially, and also the transverse position of blades 32*a* and 34*a* along the respective cutting paths are adjusted to provide a cutting clearance 36*a*. As blades 32*a* and 34*a* are essentially co-planar in this configuration, a potentially thinner effective "scissor" results which may, under certain circumstances, result in reduced blade leavings and a narrower gap 38*a*. The choice of configurations in FIGS. 4*a* and 4*b* or FIGS. 5*a* and 5*b*, or a hybrid combination thereof, will depend on many factors including the particular application and web material, as well as the construction of blade holders and the transport mechanism, to be discussed henceforth.

In accordance with the invention, there is also provided means for simultaneously transporting the pair of cooperating blades transversely across the web and longitudinally in the direction of web conveyance. As embodied herein, and as best seen in FIG. 1, transporting means 40 includes two travelling carriage means 42 and 44 positioned adjacent web surfaces 20 and 22, respectively. Travelling carriage means 42 includes endless belt means 46 positioned and supported in stationary frame 50 to extend across the web at an angle 51 (see FIG. 1 and FIG. 4*b*). Similarly, the lower travelling carriage means 44 has an endless belt means 48 positioned and supported by stationary frame 52 to extend across the web at an angle 53 to axis 14. It is preferred that angles 51 and 53 are equal and that the travelling carriage means 42 and 44 be positioned at essentially the same position along the longitudinal axis 14, except for small variations in axial distance to provide the cutting clearance between the cooperating blades as described previously.

It is also preferred, and as best seen in FIG. 1, that endless belt means 46 includes a pair of endless chains 54 and 56 positioned in axially spaced relations and in parallel planes perpendicular to the surface 20 of web 12. Chains 54 and 56 are conventionally mounted such as on sprocket wheel pairs 58 and 60 which are mounted on and keyed to shafts 62 and 64, respectively. Shafts 62 and 64 are also conventionally mounted to frame 50 such as by pillow blocks pairs 66 and 68. Chains 54 and 56 are tensioned by conventional means such as screw-bolts 70 shown connecting frame 50 and pillow block pair 56.

Endless belt means 48 is constructed essentially identical to the endless belt means 46, that is, having similar components but positioned facing major surface 22 of web 12. The components of endless belt means 48 will not be described in further detail but are considered to be apparent to one of ordinary skill in the art based on the previous discussions for the components of endless belt means 46.

As is embodied herein, endless belt means 46 and 48 are synchronized by gears 112 and 114, which gears are mounted and keyed to appropriate drive shafts of the respective travelling carriage means, such as gear 112 being keyed to shaft 64 of the travelling carriage means 42. Synchronization is essential to ensure cooperation between the blades 32 and 34 in order to produce the "scissoring" effect. Other synchronizing mechanisms and apparatus are possible and are considered within the scope of the present invention.

Figure 2:
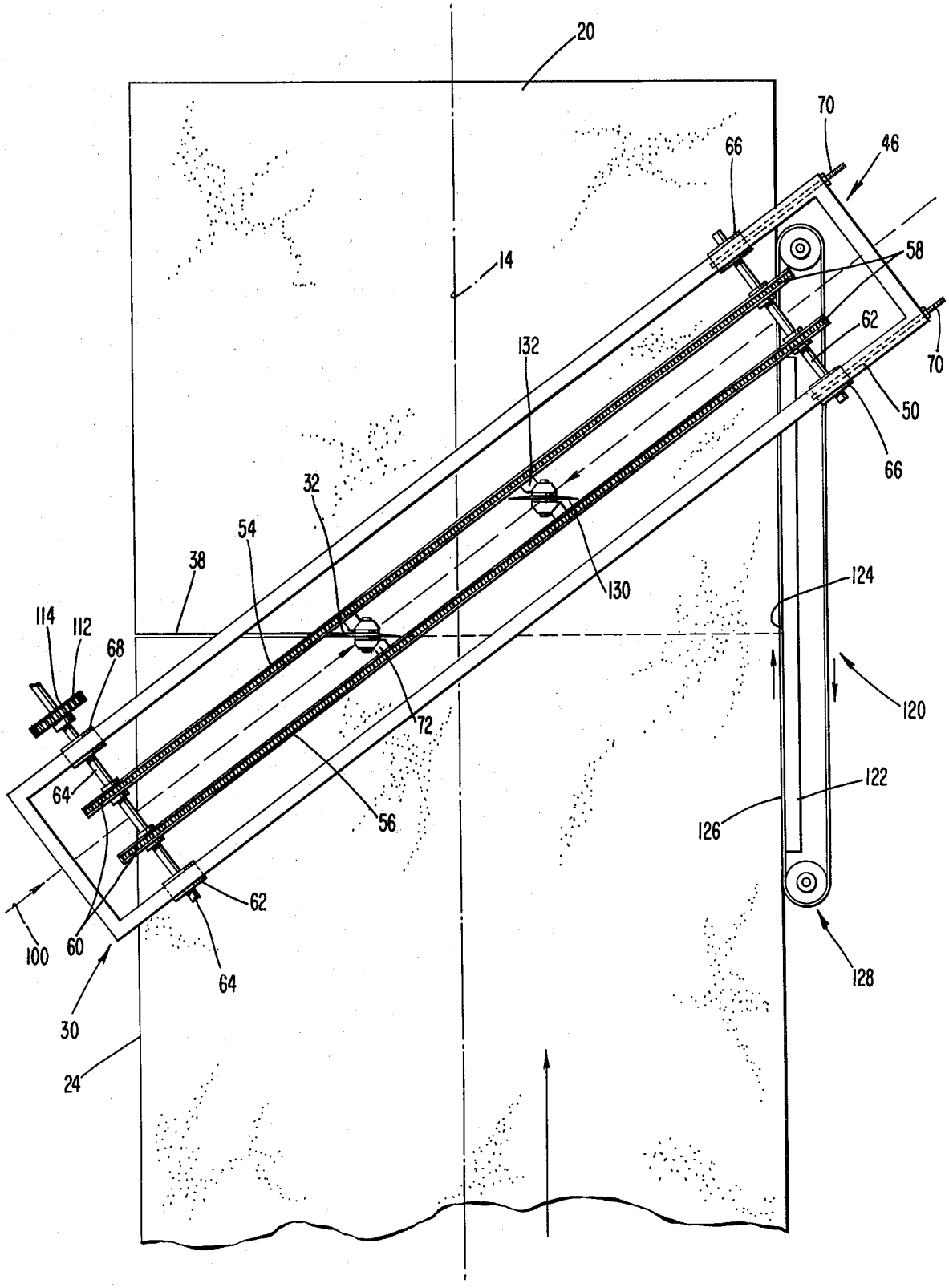
FIG. 2 is a top view of the apparatus of FIG. 1.

In accordance with the invention, means associated with the transporting means are provided for aligning the individual cooperating blades with the planes of the blades pependicular to the longitudinal axis of the web. As embodied herein, and as best seen in FIGS. 2 and 3 in relation to blade 32, the aligning means includes a blade-holder assembly 72 for mounting blade 32 to chains 54 and 56 for suspension therebetween. A similar blade-holder assembly is provided for cooperating blade 34 but that assembly is essentially identical to blade-holder assembly 72 to be described in detail henceforth.

The individual blade holder assembly 72 shown in FIG. 3 includes boss members 74 and 76 with parallel mounting faces 78 and 80, respectively. Boss members 74 and 76 are spaced by sleeve assembly 82 positioned between mounting faces 78 and 80, and the boss members 74 and 76 are also rigidly coupled by bolt assembly 84. Blade 32 is mounted for rotation on sleeve assembly 82 in a conventional manner. Boss members 74 and 76 are connected to chains 54 and 56 by a plurality of extended chain-link pins 86. Other configurations and mounting arrangements are possible for blade-holder assembly 72 and are within the scope of the present invention.

In operation, as web 12 is carried along conveyor 16, the respective pairs of chains, including chains 54 and 56, are driven to cause blades 32 and 34 and their respective holder assemblies, such as assembly 72, to travel transversely across the web and also longitudinally in the direction of web conveyance in carriage paths 100 and 102 (see FIGS. 4*a* and 4*b* and FIGS. 5*a* and 5*b*) and, due to the nature of the endless belts, to return along return paths 104 and 106 (see FIG. 1). The lengths, speeds, and the angles of orientation of the endless belt means 46 and 48, that is, angles 51 and 53 (see FIG. 4*b*), are selected with regard to the speed of conveyor 16 to result in a cut board of a predetermined length having a cut edge 108 that is substantially perpendicular to the web axis 14 (see FIG. 1). In other words, the velocity component of the blades in the direction of axis 14 should match the speed of the web. As the individual blades are not moving longitudinally with respect to the web, the blades should be mounted with their planes essentially perpendicular to axis 14 to achieve efficient cutting. However, as the blades are mounted in blade-holder assemblies which transverse non-perpendicular paths, the individual blade, such as blade 32, must be oriented with its plane 110 (FIG. 3) inclined to the respective carriage paths of the endless belt means, such as carriage path 100 of endless belt means 46 (FIG. 3), by an angle A which is computed as follows:

$$A=90^\circ-B$$

where B is the angle between the web axis 14 and the respective carriage path, that is, angle 51 or 53 in FIG. 4*b*.

This blade orientation can be effected by suitable design of the blade mounting components of the blade holder assemblies, such as mounting faces 78 and 80 of assembly 72, which faces are fabricated at angles A to the chains 54 and 56. Various modifications of assembly 72 are possible and considered within the skill of the ordinary practitioner, including a design of a blade holder assembly to permit variations in the orientation of the blade.

It is preferred that means be provided for adjusting the speed of the endless belt means to compensate for changes in the speed of the conveyed web. As embodied herein, synchronizing gears 112 and 114 are driven from the conveyor drive means 18 through conventional coupling means 116. In this manner, the speeds of both endless belt means 46 and 48 can be synchronized with the speed of web 12 and any variations in the speed of web 12 will produce corresponding and compensating variations in the speeds of endless belt means 46 and 48, thus permitting a perpendicularly transverse cutting action to be maintained.

As best seen in FIGS. 4*a* and 4*b* and FIGS. 5*a* and 5*b*, it will be appreciated that the opposing forces produced by the action of blades 32 and 34 (and 32*a* and 34*a*) on web 12 have unbalanced components parallel to the major web surfaces 20 and 22 and directed from edge 24 toward edge 26 of web 12. Unless balanced by frictional forces developed by web 12 against conveyor 16 or some other biasing force, these unbalanced cutter forces can act to move web 12 out of alignment, causing non-perpendicular cutting, and possibly jamming the web-forming and conveying apparatus.

As embodied herein, means are provided for biasing the web against the parallel force components. As seen in FIG. 2, biasing means 120 includes an elongated stationary support 122 positioned parallel to, and spaced from, web edge 26, which edge is the last cut by the cooperating blades 32 and 34. Support 122 has a planar face 124 which extends along substantially the entire longitudinal web distance over which the cooperating blades engage and scissor the web. Support 122 terminates just short of the position where blades 32 and 34 exit edge 26 to provide clearance for passage of the blades.

Positioned in the space between the support face 124 and web edge 26 is a bearing strip 126. Web edge 26 is urged against strip 126 by the unbalanced parallel force components causing the strip to move along with the web. Strip 126 should therefore be made of a material to provide a low frictional resistance between strip 126 and support face 124. Strip 126 can be part of an endless belt 128 which can be driven in the direction shown in FIG. 2 to prevent slippage between strip 126 and web edge 26. The apparatus (not shown) for driving endless belt 128 also can be coupled to the conveyor drive means 18 to provide synchronization between biasing means 120 and the other components of the disclosed apparatus.

In the preferred embodiment shown in FIG. 1, wherein chain pairs such as 54 and 56 comprise the endless belt means such as 46, for a given angle of inclination and web speed, the speed of the chains remains substantialy constant during the cutting stroke and the return stroke, except to accommodate variations in the web speed. Changes in the predetermined lengths are accomplished by changing the angle of inclination of the endless belt means 46 and 48 and adjusting the speeds accordingly, rather than by changing the lengths of chains 54 and 56, although the latter mode is within the intended scope of the invention. Also within the scope of the invention is varying the speed of the cutting and return strokes.

More than one blade can be mounted on each of the respective endless belt means, such as endless belt means 46, to provide additional pairs of cooperating blades during operation of the apparatus. As shown in FIG. 1, the additional blades and associated blade holder assemblies, such as blade 130 and assembly 132 mounted on endless belt means 46, must be equally spaced along the respective endless belt means to achieve uniform cut board lengths. Also, it should be appreciated that the total number of blades on and the spacing intervals on each endless belt means must be the same to ensure cooperation of the blades and the shortened "effective" chain length must be taken into consideration when calculating the inclination and speed to achieve perpendicular cut boards of a predetermined length.

It will be apparent to those skilled in the art that modifications and variations can be made in the apparatus of the present invention without departing from the scope or spirit of the invention. Thus, it is intended that the present invention cover the modifications and variations of this invention provided that they come within the scope of the appended claims and their equivalents.

What is claimed is:

1. Apparatus for transversely cutting into predetermined lengths a continuous strip-like web, the web being conveyed along its longitudinal axis, the apparatus comprising:

(a) means for simultaneously engaging and cutting into the moving web at both major web surfaces, said means including at least one pair of cooperating blades;

(b) means for simultaneously transporting said blade pair transversely across the web and longitudinally in the direction of conveyance of the web, wherein each blade of said pair cooperates with the other blade to provide mutually opposing forces biasing the web against the cutting action of each of said cooperating blades for completely severing the web through its thickness;

(c) means associated with said transporting means for aligning each blade of said blade pair such that the plane of the respective blade is perpendicular to the longitudinal axis of the web, and wherein said mutually opposing forces also have force components parallel to the web surface; and (d) means for biasing the web against said parallel force components, said biasing means including means moveable with the web for abutting a web edge and non-moving support means.

2. Apparatus as in claim 1 wherein said biasing means biases the web along substantially the entire longitudinal web distance over which said cooperating blades engage the web material.

3. Apparatus as in claim 1 wherein said biasing means includes (a) a stationary support having a planar face positioned parallel to and spaced from the web edge last cut by said cooperating blades; and (b) a movable bearing strip positioned between and contacting said last cut web edge and said support face, said bearing strip moving in the same direction as, and at substantially the same speed as, the conveyed web, the contact between said bearing strip and said support face being a sliding contact with low friction resistance.

4. Apparatus as in claim 3 wherein said bearing strip is part of an endless belt.

5. Apparatus as in claim 3 wherein said moveable bearing strip is driven by frictional engagement between said strip and the web.

6. Apparatus for transversely cutting into predetermined lengths a continuous strip-like web, the web being conveyed by driven conveyor means along the web longitudinal axis, the apparatus comprising:

(a) means for simultaneously engaging and cutting into the moving web at both major web surfaces, said means including at least one pair of freely rotatable, disk-shaped blades;

(b) means for simultaneously transporting said blade pair transversely across the web and longitudinally in the direction of conveyance of the web, said transporting means including (1) first stationary frame means positioned adjacent one major surface of the web, (2) first travelling carriage means supported in said first frame means and oriented to traverse the web along a first carriage path disposed at an acute angle to the longitudinal axis of the web, said first carriage means having a first endless belt means supported in said first frame means and positioned along said first carriage path, said first endless belt means comprising a first pair of endless chains mounted side-by-side and spaced along the longitudinal axis, (3) second stationary frame means positioned adjacent the other major surface of the web, (4) second travelling carriage means supported in said second frame means and oriented to traverse the web along a second carriage path disposed at said acute angle to the longitudinal axis of the web, said second carriage means having a second endless belt means supported in said second frame and positioned along said second carriage path, said second endless belt means comprising a second pair of endless chains mounted side-by-side and spaced along the longitudinal axis, and (5) means for synchronizing the speed of said first travelling carriage means with the speed of said second travelling carriage means; wherein each blade of said pair of blades cooperates with the other blade to provide mutually opposing forces biasing the web against the cutting action of each of the cooperating blades for completely shearing the web through its thickness, said synchronizing means including means for driving said first and second endless belt means by said driven means to continuously adjust and control the speeds of said first and second endless belt means to compensate for variations in the conveyed web speed; and (c) means associated with said transporting means for aligning each blade of said blade pair such that the respective blade plane is perpendicular to the longitudinal axis of the web, said aligning means including a plurality of assemblies for holding the individual blades of said blade pair, said blade-holder assemblies being secured to each chain of the respective one of said first and second chain pairs for suspension therebetween.

7. Apparatus as in claim 6 wherein said mutually opposing forces also have force components parallel to the web surface, the apparatus further including means for biasing the web against said parallel force components, said biasing means including a stationary support having a planar face positioned parallel to and spaced from the web edge last cut by said cooperating blades, said support and said face extending along substantially the entire longitudinal web distance over which said cooperating blades engage the web material; and a moveable bearing strip positioned between and contacting said last cut web edge and said support face, said bearing strip being part of an endless belt moving in the same direction as, and at substantially the same speed as, the conveyed web, the contact between said bearing strip and said support face being a slidable contact with low friction resistance.

8. Apparatus for transversely cutting into predetermined lengths, a continuous strip-like web, the web being conveyed along its longitudinal axis, the apparatus comprising:

(a) means for simultaneously engaging and cutting into the moving web at both major web surfaces, said means including at least one pair of cooperating first and second blades;

(b) means for simultaneously tranporting said blade pair transversely across the web and longitudinally in the direction of conveyance of the web, said transporting means including (1) first travelling carriage means positioned adjacent one major surface of the web and oriented to traverse the web along a first carriage path disposed at a first angle to the longitudinal axis of the web, said first travelling carriage means carrying said first blade;

(2) second travelling carriage means positioned adjacent the other major surface of the web and oriented to traverse the web along a second carriage path disposed at a second angle to the longitudinal axis of the web, said second travelling carriage means carrying said second blade;

(3) means for synchronizing the speed of said first travelling carriage means with the speed of said second travelling carriage means wherein said first blade cooperates with second blade to provide mutually opposing forces biasing the web against the cutting action of each of said cooperating blades for completely severing the web through its thickness; and (c) means associated with said transporting means for aligning each blade of said blade pair such that the plane of the respective blade is perpendicular to the longitudinal axis of the web, wherein said transporting means includes first and second stationary frame means positioned adjacent the opposite major web surfaces, and wherein said first and second travelling carriage means include, respectively, first and second endless belt means supported in said respective frame means to span the web along respective ones of said first and second carriage paths, and wherein said aligning means includes a plurality of assemblies for holding the individual blades of said blade pair, said blade-holder assemblies being attached to the respective ones of said first and second endless belt means.

9. Apparatus as in claim 8 wherein the interval from the time said cooperating blades first cuttingly engage the web at one edge to the time said cooperating blades cuttingly disengage the web at the other edge, and the direction said transporting means carries said cooperating blades are selected in relation to the speed of the conveyed web to effect a transverse cut substantially perpendicular to the longitudinal axis of the web.

10. Apparatus as in claim 9 wherein the web is a fiberglass-reinforced foamed insulation material being conveyed at less than or equal to about 200 feet/minute along the longitudinal axis; the web thickness is about ½ inch to about 3 inches; and the predetermined lengths are about 3 feet to about 16 feet; and wherein said means also severs completely the fiberglass, the tolerance on the predetermined lengths of the cut insulation material being about ±1/32 inch in the longitudinal direction.

11. Apparatus as in claim 8 wherein said first and second travelling carriage means are positioned at about the same point along the longitudinal axis of the web, and the sum of the depths of penetration into the respective web surfaces of each of said cooperating blades is equal to or greater than the web thickness, and wherein said first and second carriage paths are parallel and said first and second angles are equal.

12. Apparatus as in claim 11 wherein the planes defined by said first and second blades are substantially perpendicular to the longitudinal axis of the web and wherein said cooperating blades are spaced one from the other along said respective carriage paths to provide a cutting clearance between said cooperating blades.

13. Apparatus as in claim 11 wherein said first and second carriage paths are spaced axially to provide a cutting clearance between said cooperating blades.

14. Apparatus as in claim 11 wherein the respective penetration depths of said cooperating blades are equal.

15. Apparatus as in claim 8 wherein each blade of said pair of blades is disk-shaped and rotatable about its axis; wherein each blade of said pair of blades is freely rotatable; and wherein each blade rotates in an angular direction opposite to that of the cooperating blade.

16. Apparatus as in claim 8 wherein said first and second angles and the speeds of said first and second endlesss belt means are determined in relation to the speed of the conveyed web to effect a transverse cut substantially perpendicular to the longitudinal axis of the web.

17. Apparatus as in claim 8 wherein said synchronizing means further includes means for continuously adjusting and controlling the speeds of said first and second endless belt means to compensate for variations in the conveyed web speed.

18. Apparatus as in claim 17 wherein said web is being conveyed on driven conveyor means, and wherein said belt-speed control means includes means for driving said first and second endless belt means by said driven conveyor means.

19. Apparatus as in claim 8 wherein the return paths of said first and second endless belt means are positioned adjacent the same web face as respective ones of said first and second carriage paths and are spaced farther from the respective web surfaces than the respective ones of said first and second carriage paths.

20. Apparatus as in claim 8 wherein said plurality of blade-holder assemblies are equally spaced along respective ones of said first and second endless belt means.

21. Apparatus as in claim 20 wherein the spacing between adjacent ones of said plurality of blade-holder assemblies on each respective endless belt means is coordinated with the speed of the conveyed web, said first and second angles, and the speeds of said first and second endless belt means to provide the pedetermined lengths of material having cut edges substantially perpendicular to the longitudinal axis of the web.

22. Apparatus as in claim 8 wherein the web is conveyed horizontally and said first and second travelling carriage means are positioned one above and one below the web.

23. Apparatus as in claim 8 wherein each of said first and second endless belt means includes at least one endless chain.

24. Apparatus as in claim 8 wherein each of said first and second endless belt means includes a pair of endless chains mounted side-by-side, in spaced relationships, and wherein each of said plurality of blade-holder assemblies is attached by securing means to each chain in the respective pair for suspension therebetween.

25. Apparatus as in claim 24 wherein said securing means includes one or more elongated chain-link pins.

26. A method for transversely cutting into predetermined lengths a continuous strip-like web, the web being conveyed along its longitudinal axis, the method comprising:

(a) engaging, at one major web surface, a first longitudinal edge of the web with a first blade aligned with its plane perpendicular to the web longitudinal axis;

(b) engaging, at the opposite major web surface and at the approximate axial position of engagement of said first blade, the first longitudinal edge of the web with a second blade aligned with its plane perpendicular to the web longitudinal axis;

(c) moving together in cooperating relationship said first and second blades transversely across the web and longitudinally in the direction of web conveyance at speeds determined in relation to the web speed and the angle of movement with respect to the longitudinal axis for providing a cut edge perpendicular to the longitudinal axis of the web, said first and second blades providing mutually opposing forces biasing the web against each of said blades for shearing the web therebetween;

(d) disengaging said first and second blades from the web at the other longitudinal edge of the web;

(e) returning said first and second blades to the first longitudinal edge by separate return paths; and (f) biasing the web during the period the blades engage the web with biasing means having a moving member and a non-moving member against unbalanced force components directed parallel to the major web surfaces, said unbalanced parallel force components being produced by said first and second blades and being directed from the first longitudinal web edge toward the other longitudinal web edge, said biasing step including the steps of (i) contacting the other longitudinal web edge with the moving member of said biasing means (ii) slidingly supporting said moving member with the non-moving member of said biasing means.

27. The method as in claim 26 wherein said moving step includes the substeps of (i) synchronizing, and (ii) continuously adjusting and controlling the speeds of said first and second blades to compensate for variations in the web speed.

28. The method as in claim 26 wherein the contacting substep (f)(i) includes the step of moving the moving member by frictionally engaging the other longitudinal web edge with the moving member.

* * * * *